United States Patent [19]

Livick

[11] 4,051,758

[45] Oct. 4, 1977

[54] BREAD SLICER USEABLE BY A BLIND PERSON

[76] Inventor: Lester R. Livick, 15106 Beatty St., San Leandro, Calif. 94579

[21] Appl. No.: 769,840

[22] Filed: Feb. 17, 1977

[51] Int. Cl.[2] ..... B26D 4/50

[52] U.S. Cl. ..... 83/437; 83/449; 83/468; 83/522; 83/761

[58] Field of Search ..... 83/761, 762, 437, 449, 83/468, 522; 269/290–295

[56] References Cited

U.S. PATENT DOCUMENTS

| | | | |
|---|---|---|---|
| 1,589,030 | 6/1926 | Whiting | 83/761 |
| 2,649,658 | 8/1953 | Nelson | 83/761 |

FOREIGN PATENT DOCUMENTS

| | | | |
|---|---|---|---|
| 904,254 | 8/1962 | United Kingdom | 83/761 |

*Primary Examiner*—J. M. Meister
*Attorney, Agent, or Firm*—William R. Piper

[57] ABSTRACT

A bread slicer that can be used by a person with normal sight but especially designed to be readily used by a blind person. Adjustable means is provided for advancing the loaf of bread, or other object to be sliced, the same measured distance toward a cutting knife each time a slice is cut so that the slices will be of uniform thickness. Equally spaced apart notches are associated with the loaf advancing means so that a blind person can feel these notches and can move the loaf one notch at a time to obtain slices of the same thickness. The sides of the loaf are gripped during the cutting operation. A pair of guides for the cutting knife are magnetized for supporting the knife when not used.

2 Claims, 3 Drawing Figures

3
3
2
2
K
14
2
B
3
18
18a
M
L
1
15
12
11
23
24
22
10
J
A
F
8
8
G
17
19
19a
R
N
16
4
7
9
C
5
E
9
7
D
Q

H
19
19a
P
B
3
11
2
Q
D
7
9
C
E
7
9
5
4
21
A
6
21

18
18a
L
P
17
B
K
11
2
3
13
14
15
2 3 4 5 6 7 8 9 10 11 12 13 14 15 16
Q
20
B
21
A
21

BREAD SLICER USEABLE BY A BLIND PERSON

SUMMARY OF THE INVENTION

An object of my invention is to provide a bread slicer that can be operated by either a person with normal eyesight or by a blind person. The device has a novel notched scale to be used by a blind person in cutting slices of uniform thickness. It also has a calibrated scale useable by a person who can see. The guide for the cutting knife also functions as a barrier to prevent the hands of a blind person from contacting the cutting edge of the knife. In addition the knife guide comprises two vertical posts spaced apart so that the loaf of bread can be advanced therebetween and then the knife reciprocated using the posts as guides for the knife blade. The metal posts ae magnetized and will support the metal knife blade when the knife is not used.

DESCRIPTION OF THE PREFERRED EMBODIMENT

Figure 1:
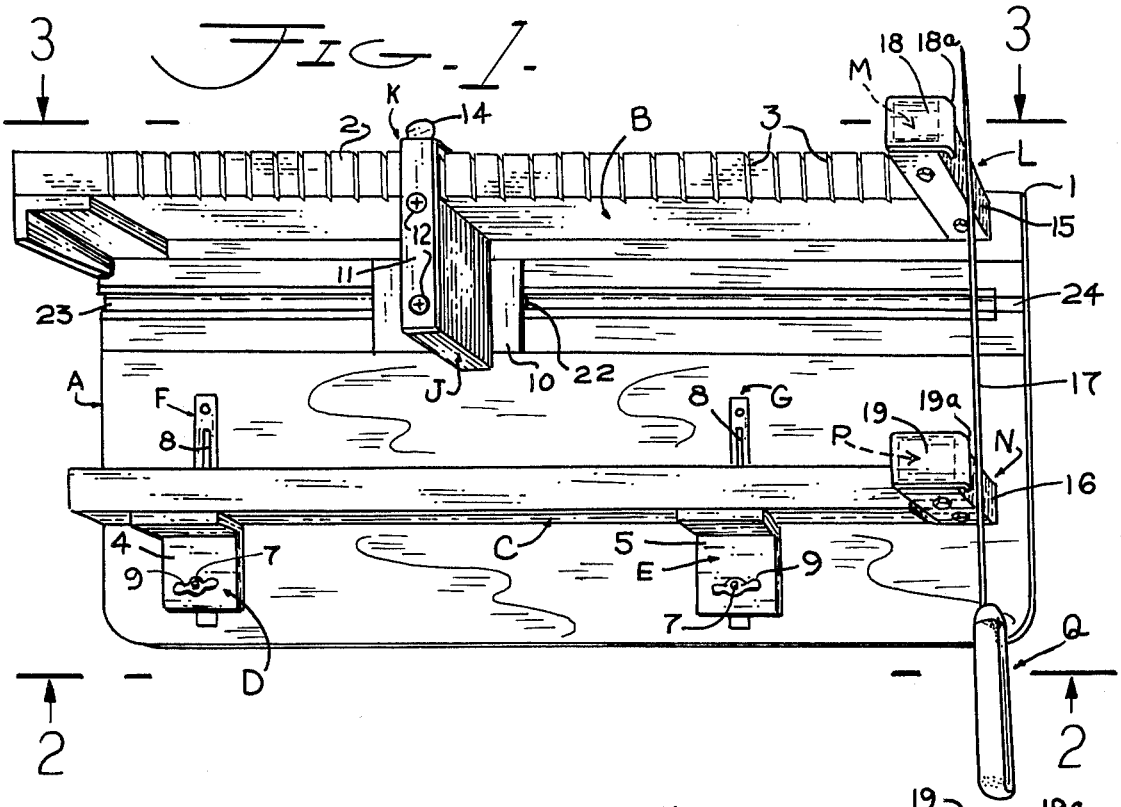
FIG. 1 is an overhead perspective view of the bread slicer.

In carrying out my invention I provide a base indicated generally at A, in all three Figures of the drawing. The base supports a side wall B which is secured to the base adjacent to the base edge 1, see FIG. 1. The upper edge 2 of the side wall B has a notched scale in which the notches are spaced equal distances apart and each notch 3 is preferably formed by a V-shaped groove that extends transversely across the width of the top 2 of the stationary side wall B. These notches 3 can be felt by the fingers of a blind person when using the bread slicer for slicing bread and the like.

Figure 2:
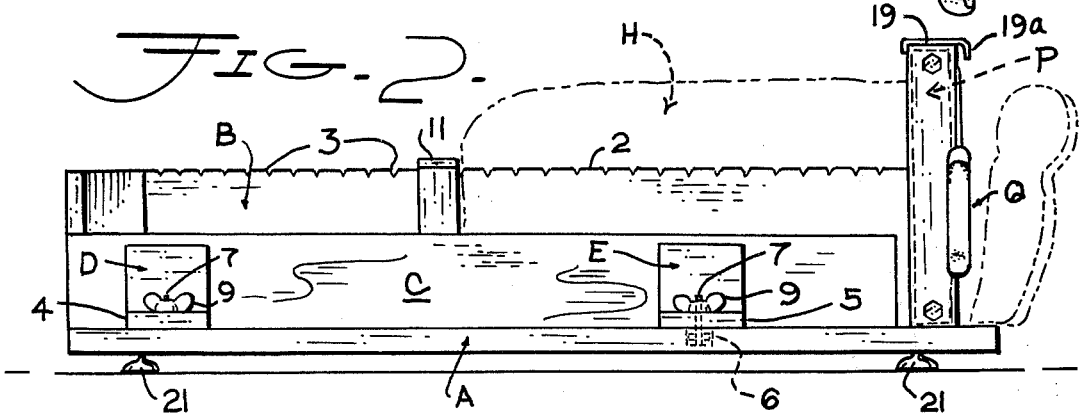
FIG. 2 is a front elevation of the device when looking in the direction of the arrows 2—2 of FIG. 1.

Before describing the means for advancing a loaf of bread a premeasured distance toward a bread cutting knife for cutting a slice of bread of a predetermined thickness, I will first describe an adjustable side wall C that cooperates with the stationary wall B, for clamping a loaf of bread, or other objects to be sliced, therebetween, see FIGS. 1 and 2. The wall C has a pair of angle-shaped brackets D, and E secured thereto. The bases 4 and 5 of the brackets D and E, respectively, are slidable over the upper surface of the base A.

The base A has transversely extending grooves in its upper surface and these grooves 6 parallel each other and are positioned under the brackets D and E. Slotted guide rails F and G, extend along the tops of the transverse grooves 6 and their upper surfaces lie flush with the upper surface of the base A. Bolts 7 have their shanks slidable received in the slots 8 in the guide rails F and G. The bolt heads slide in the slots 6 in the base A, and wing nuts 9 on the bolt shanks when tightened secure the brackets D and E to the base and hold the adjustment side C from moving and in a parallel relation to the fixed side wall B.

A loaf of bread H, is shown by dot-dash lines in FIG. 2, and it is positioned between the two side walls B and C, see also FIG. 1. I provide an adjustable loaf feeding means and I show a loaf pusher J, which is preferably rectangular in shape and extends vertically above a movable base member 10 to which it is attached. The loaf pusher extends transversely to the adjacent surface of the stationary wall B, and projects inwardly toward the adjustable wall C.

An angle-shaped strap K has a top horizontal portion 11 secured to the upper edge of the loaf pusher J, by screws 12, see FIG. 1. The portion 11 extends over the upper edge 2 of the fixed wall B, and then the downwardly bent portion 13 of the angle-shaped strap K parallels the outer face of the wall B, and functions as a marker as it is slidable along a visual scale 20, on this outer face that is marked off in equal measurements such as inches. A set screw 14 with a wing-shaped head is threaded into a threaded opening in the downwardly bent portion 13 and it may be tightened against the adjacent surface of the fixed wall B, for securing the loaf pusher from moving. The movable base 10 that supports the loaf pusher J, has a tongue 22 on its under surface that is free to slide in a track 23 placed in a groove 24, see FIG. 1, provided in the upper surface of the base A. The track 23 is received in a groove 24 in the base A which parallels the fixed wall B, and is spaced therefrom.

At the right hand end of the fixed wall B, I mount a hollow post L that extends upwardly from the base A, see FIG. 1. This post is rectangular in cross section and has metal walls. An elongated permanent magnet M, is enclosed within the hollow post so as to magnetize its walls. A second hollow post N, similar to the hollow post L, houses a permanent magnet P, see FIGS. 1 and 3. The flat side 15 of the post L, and the flat side 16 of the post N, both lie in the same vertical plane which extends at right angles to the vertical parallel walls B and C. These two walls 15 and 16 are magnetized by the magnets M, and P, and will hold the metal blade 17 of a bread knife Q, against the walls with sufficient magnetic attraction to hold the knife at any position along the walls. Yet this magnetic attraction will permit the knife to be manipulated to slice the bread H, and to tend to maintain the knife blade in contact with the two walls during this slicing operation so that bread slices of uniform width will be cut from the loaf.

Figure 3:
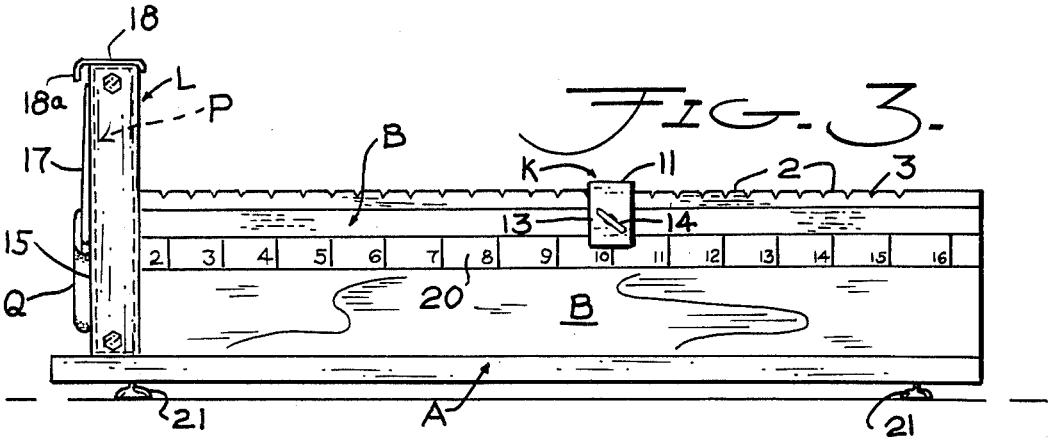
FIG. 3 is an elevational view of the opposite side of the device from that of FIG. 2 and when looking in the direction of the arrows 3—3 of FIG. 1.

FIGS. 2 and 3 illustrate the tops of the hollow posts L and N, closed by covers 18 and 19, respectively, and further show both covers with over-hanging lips 18*a* and 19*a* with downwardly turned flanges that are spaced from the magnetized walls 15 and 16. These overhanging lips function as stops to prevent the lifting of the knife blade 17 above the tops of the posts L and N. The stops 18*a* and 19*a* are positioned high enough above the top of the loaf of bread H that when the knife blade contacts these lips and is held thereby the magnetized walls 15 and 16, there will be sufficient space under the knife blade to move the loaf of bread into a new slice cutting position. FIG. 2 shows a slice of bread by dot-dash lines that has just been cut from the loaf.

Uniform slices of bread can be cut from the loaf H by a blind person. The angle-shaped strap K, on the loaf pusher J, functions as a marker as its top horizontal portion 11 slides over the equally spaced notches 3 on the top edge 2 of the fixed wall B. A blind person can loosen the set screw 14 and then move the loaf pusher J so that one side of the top portion 11 will register with the next notch 3. This will advance the loaf beyond the upraised knife blade 17 a distance equal to the width between two successive notches 3. The handle of the bread knife Q, may now be grasped and the bread slice cut from the loaf, care being taken that the blade 17 is in constant contact between the two magnetized walls 15 and 16 during the cutting operation. The notches 3 can be spaced any desired distance apart from each other and will determine the thickness of the bread slices.

A person using the bread slicer who is not blind can use the visual scale 20 on the outer side of the wall B, see FIG. 3. An edge of the downwardly bent portion 13 of the angle-shaped strap K, can be used as a marker and can be registered successively with the spaced graduations on the scale 20. If desired, the base A may be supported by vacuum-cupped feet 21, see FIGS. 2 and 3, so that the bread cutter will be held firmly to a supporting surface during the bread cutting operation.

I claim:

1. A bread slicer comprising:

a. a base;

b. an upright wall fixed to said base;

c. an adjustable upright wall paralleling said fixed wall and being spaced therefrom;

d. means for guiding said adjustable wall for maintaining it parallel to said fixed wall as it is adjusted toward or away therefrom to accommodate an object to be sliced such as a loaf of bread;

e. a loaf pusher slidably mounted between said walls and being movable in a direction paralleling the two walls;

f. a marker carried by said loaf pusher and having a portion overlying the upper edge of said fixed wall, said upper edge having equally spaced apart grooves constituting a scale that can be used by a blind person;

g. a pair of upright magnetized posts positioned near one end of said base so as not to interfere with the object to be sliced from being moved between said posts; and h. said posts adapted to magnetically attract and support the metal blade of a knife and to act as a guide for the slicing operation as the operator keeps the blade in contact with the posts while cutting.

2. The combination as set forth in claim 1; and in which a. each magnetized post has a flat side, both of which lie in the same vertical plane that extends at right angles to the lengths of the fixed and adjustable walls; and b. covers for the tops of said posts, each cover having a lip overhanging the top of the magnetized flat side and constituting a stop for the upward movement of the knife blade prior to the next slicing operation by the knife.

* * * * *